US011035133B2

(12) United States Patent
Grafenauer

(10) Patent No.: US 11,035,133 B2
(45) Date of Patent: Jun. 15, 2021

(54) DEVICE FOR LOCKING TWO FLOOR PANELS

(71) Applicant: Falquon GmbH, Pritzwalk (DE)

(72) Inventor: Thomas Grafenauer, Lichtenau (AT)

(73) Assignee: FALQUON GMBH, Pritzwalk (DE)

( * ) Notice: Subject to any disclaimer, the term of this patent is extended or adjusted under 35 U.S.C. 154(b) by 0 days.

(21) Appl. No.: 16/609,641

(22) PCT Filed: May 18, 2018

(86) PCT No.: PCT/EP2018/063032
§ 371 (c)(1),
(2) Date: Nov. 12, 2019

(87) PCT Pub. No.: WO2018/211054
PCT Pub. Date: Nov. 22, 2018

(65) Prior Publication Data

US 2020/0063442 A1 Feb. 27, 2020

(30) Foreign Application Priority Data

May 18, 2017 (DE) ..... 10 2017 110 878.5
May 18, 2017 (DE) ..... 10 2017 110 880.7

(51) Int. Cl.
*E04F 15/02* (2006.01)

(52) U.S. Cl.
CPC *E04F 15/02038* (2013.01); *E04F 2201/0107* (2013.01); *E04F 2201/0138* (2013.01);
(Continued)

(58) Field of Classification Search
CPC ..... E04F 15/02038; E04F 2201/0107; E04F 2201/0138; E04F 2201/0511; E04F 2201/0541; E04F 2201/0153
See application file for complete search history.

(56) References Cited

U.S. PATENT DOCUMENTS 6,854,235 B2 * 2/2005 Martensson ..... E04F 15/04 52/601
8,042,311 B2 * 10/2011 Pervan ..... E04F 13/0894 52/586.1

(Continued)

FOREIGN PATENT DOCUMENTS

DE 4406295 5/1995
DE 20205774 8/2002

(Continued)

OTHER PUBLICATIONS

International Search Report in related International Application No. PCT/EP2018/063032 dated Nov. 22, 2018, 5 pages.

(Continued)

*Primary Examiner* — Brian E Glessner
*Assistant Examiner* — Daniel J Kenny
(74) *Attorney, Agent, or Firm* — Andrew M. Calderon; Roberts Calderon Safran & Cole, P.C.

(57) ABSTRACT

The disclosure relates to a device for locking two interconnected floor panels that are identically embodied and includes a core, an upper side and a lower side, and a first lateral edge (I) and a second lateral edge (II) opposite the first lateral edge. On the upper side, the first lateral edge (I) of the first floor panel abuts against the second lateral edge (II) of the second floor panel. A horizontal groove extending into the core is embodied in the second lateral edge (II), with an upper wall, an inner wall and a lower wall, the lower wall being formed from a lower lip projecting on the first lateral edge (I), which, on the outer end thereof, has a projection that is oriented towards the upper side and has a first locking edge, and at least one locking element is inserted in the region of the connection point of the two floor panels. An outwardly projecting spring is provided on the second lateral edge (II), and includes a step forming a spring tip on the outer end thereof, and on the end thereof facing the core, a (Continued)

second locking edge extending in the vertical direction (V), the locking edge being the outer wall of a vertical groove open towards the lower side, in which the projection engages. The locking takes place, in the vertical direction, by means of the spring tip engaging in the horizontal groove, and in the horizontal direction, by means of the locking element supported on the first locking edge of the projection and on the second locking edge of the spring. The disclosure is characterised in that the locking element is compressible in the vertical direction (V) and not compressible in the horizontal direction.

16 Claims, 5 Drawing Sheets

(52) U.S. Cl.
CPC ..... *E04F 2201/0511* (2013.01); *E04F 2201/0541* (2013.01)

(56) References Cited

U.S. PATENT DOCUMENTS 8,336,272 B2 * 12/2012 Prager ..... F16B 5/0044 52/588.1
8,381,476 B2 * 2/2013 Hannig ..... E04F 15/02 52/582.1
9,194,134 B2 * 11/2015 Nygren ..... E04F 15/02038
10,214,916 B2 * 2/2019 Schulte ..... E04F 15/02038
2007/0151189 A1 7/2007 Yang

FOREIGN PATENT DOCUMENTS

| | | |
|---|---|---|
| DE | 20122020 | 12/2003 |
| DE | 10230818 | 3/2004 |
| DE | 102008003550 | 7/2009 |
| DE | 102007032885 | 1/2016 |
| DE | 102015106035 | 2/2016 |
| EP | 2915934 | 10/1980 |
| EP | 1420125 | 5/2008 |
| WO | 0102669 | 1/2001 |
| WO | 0175247 | 10/2001 |

OTHER PUBLICATIONS

Written Opinion in related International Application No. PCT/EP2018/063032 dated Nov. 22, 2018, 7 pages.

* cited by examiner

DEVICE FOR LOCKING TWO FLOOR PANELS

FIELD OF INVENTION

The invention relates to a device for locking two floor panels which are connected to each other and which are both constructed identically and which have a core, an upper side and a lower side, a first side edge and an opposing second side edge, and at the upper side the first side edge of the first floor panel abuts the second side edge of the second floor panel, in the second side edge there is formed a horizontal groove which extends into the core and which has an upper wall, an inner wall and a lower wall, wherein the lower wall is formed by a lower lip which protrudes at the first side edge and which has at the outer end thereof a projection which faces in the direction of the upper side and which has a first locking edge, and in the region of the connection location of the two floor panels at least one locking element is inserted, and wherein at the second side edge there is provided a tongue which protrudes outward and which has at the outer end thereof a graduation which forms a tongue tip and at the end thereof facing the core a second locking edge which extends in a vertical direction, wherein the second locking edge is the outer wall of a vertical groove which is open in a direction toward the lower side and in which the projection engages and the locking is carried out in a vertical direction by means of the tongue tip which engages in the horizontal groove and in a horizontal direction by means of the locking element which is supported, on the one hand, on the first locking edge of the projection and, on the other hand, on the second locking edge of the tongue.

BACKGROUND OF INVENTION

Such a device is known, for example, from DE 202 05 774 U1.

In the device known from DE 10 2008 003 550 A1, in order to lock two floor panels which are connected to each other in a direction perpendicular to the upper side or lower side, the locking element is inserted into the groove in such a manner that it protrudes therefrom with the free end thereof at one side and is secured with the other end thereof. A third floor panel is placed against the two floor panels which are connected to each other and connected to them, wherein the third floor panel abuts the free end of the locking element and in this instance presses the locking element in the longitudinal direction into the groove, whereby the locking element bends out in the groove in the transverse direction and as a result of the outward bending in the transverse direction also into a second groove which is provided in the opposing second floor panel, whereby the first and the second floor panels are then locked to each other.

DE 10 2007 032 885 B4 discloses a device for locking two floor panels which are connected to each other, in which device there is inserted in the groove not only the locking element, but therebetween also a compression element as a mechanical resilient element which has a plurality of resilient arms which are connected to each other in an articulated manner so that the side of the locking element facing the groove base and the side of the compression element facing the locking element are constructed so as to engage in each other. The locking element is constructed in an oblique manner at the side thereof protruding from the groove. If two panels are connected to each other in a vertical direction, the locking element is pressed into the groove and rebounds, when the panels are connected, into a recess which is provided in the newly laid floor panels and then locks the two floor panels in a vertical direction.

EP 1 420 125 B1 discloses a locking of two floor panels which are connected to each other which comprises an insert which can be pushed into a locking groove formed in the locking location. The two floor panels are connected by means of a horizontal joint connection. At the one side edge of the panels, a tongue is formed and at the opposing side edge a connection groove which corresponds to the tongue is provided. In the upper side of the tongue, an upwardly open groove is introduced and in the upper wall of the connection groove a downwardly open groove. When the tongue is inserted into the connection groove, the two grooves become aligned and then form a locking groove, in which the locking element can be inserted. The locking element may be triangular or X-shaped in cross-section with four resilient lips being formed. The problem is that between the locking element and the locking groove a positive-locking connection has to be produced in order to connect the two panels to each other in a play-free manner. The "insertion" of the locking element into the locking groove is difficult and as a result of the friction during insertion also requires force. When the locking element is hammered in, there is the risk of the locking groove or the locking element becoming damaged and the connection becoming disengaged sooner or later. Furthermore, it is problematic that oblique locking faces on the locking element and in the locking groove cooperate with each other and, when horizontal tensile forces occur in the locking location, the locking can be released so that gaps are formed at the upper side of the panels in the connection location, which is visually unacceptable.

DE 202 05 774 U1 also discloses a locking device of two floor panels which are connected to each other, in which device the mutually adjacent panels are locked by means of a compressible locking element in a horizontal direction. At the upper side, the panels are not in abutment with each other, but instead a resilient element is inserted between the connection edges in order to build a tension in the connection so that the formation of gaps is prevented. The locking element comprises, for example, silicone and can be deformed in all directions in space.

DE 44 06 295 A1 discloses a resilient strip construction for panel claddings in which the resilient strip is resilient along one of the two longitudinal edge regions thereof which engage in a panel groove and has a greater height than the panel groove width. The resilient longitudinal groove region is thereby resiliently flexible for insertion into the associated panel groove and is supported in the inserted state on the groove walls. In the visible region of the panel cladding, the resilient strip surface presses against the outer groove edge.

SUMMARY OF INVENTION

Based on this, the device described in the introduction is intended to be improved.

In order to solve this problem, a generic device for locking two floor panels which are connected to each other is characterized in that the locking element is compressible in the vertical direction and incompressible in the horizontal direction.

As a result of this embodiment, it is possible with the vertical joining movement of the panel which is intended to be newly laid to compress the locking element with the lower side of the tongue and to press it into the groove in the lower lip. If the length of the lower lip from the inner wall of the horizontal groove to the projection is greater than the length of the tongue from the tongue tip to the locking edge on the tongue, when the tongue is inserted into the groove an intermediate space is formed between the projection and the locking edge so that the locking element can become decompressed again and engages (springs) into this intermediate space and the locking groove formed in this manner. The locking in a horizontal direction is then carried out against two at least substantially vertical locking edges or at two vertical locking faces.

The core of the floor panels may comprise any appropriate material. It is possible to consider wood-based material and wood-based material/plastics material mixtures (WPC) of pure plastics material or a mixture of plastics material and mineral components, a mixture of plastics material, mineral and wood components or also purely primarily mineral cores so that as a support plate for any coating gypsum fiber boards or cement fiber boards can also be considered. The fibers do not necessarily have to be wood fibers.

The second locking edge should preferably extend so as to be slightly inclined relative to the upper side of the floor panel and/or be tapered at the bottom with a chamfer. The inclination of the second locking edge is slightly less than 90°, preferably from 85° to 89°. The side of the locking element which is associated with the second locking edge may also then be accordingly inclined, wherein the inclination angles have to be similar but not identical. With this embodiment, it may be possible for the locking element to in any case spring back in order to compensate for any production tolerances. The rebound preferably occurs as far as the end position. However, the locking element also locks when it does not reach the end position since it can always spring back.

If the first and second locking edges extend parallel with each other and particularly at an angle of less than 90° with respect to the upper side, there are formed almost vertical locking faces which can also absorb high tensile forces in a horizontal direction. A release of the locking element in the locking groove and a resultant gap formation in the upper side of the floor which has been produced from a plurality of floor panels which are connected to each other are thereby effectively excluded.

This device is particularly suitable for square shaped panels. At the other two side edges, in order to angle in a new panel relative to the row of panels which has already been laid, a profiling may be provided, as disclosed in DE 102 30 818 B3, in WO 01/75247 A1 or in WO 01/02669 A1. This profiling may also be used on the long longitudinal side when rectangular panels are formed with the profiling according to the invention at the short transverse side.

Preferably, a groove which is adjacent to the projection is provided in the lower lip for at least partially receiving the at least one locking element. This embodiment affords the advantage that the locking element is retained at a defined position which facilitates the manual insertion of the locking element when the floor panels are laid.

The locking element may be securely connected to the lower lip, preferably adhesively bonded, and may already have been secured to the panel by the manufacturer in order to facilitate the handling. Also in this instance, the locking element may be placed in the groove which is provided in the lower lip and secured at that location.

On the locking element, in a vertical direction a second locking edge or locking face which is slightly inclined and/or which is tapered at the bottom with a chamfer is advantageous so that the resilient locking element can reliably spring back even if as a result of production tolerances the second locking edge were too far to the rear (in the direction of the first locking edge) and could otherwise prevent springing upward. A locking of the panels would nonetheless occur, but the locking element would potentially not be completely decompressed. Instead of providing a chamfer on the locking edge, the locking element could also be constructed to be slightly inclined at the face facing the second locking edge.

In order to simplify the locking, the locking element is preferably at least at the side thereof facing the second locking element constructed in a slightly oblique manner or provided with a chamfer.

Preferably, a plurality of locking elements may be provided with spacing from each other.

In order to achieve a compressibility of the locking element in a vertical direction, it may, for example, be configured in a tubular or cylindrical manner and be placed in the groove in the lower lip in such a manner that the longitudinal axis thereof is orientated in the direction of the tongue tip, that is to say, in the direction of the horizontal joining movement. The tongue element may then be compressed in a vertical direction and where applicable also be redirected in the horizontal direction extending in the longitudinal direction of the side edge, but a compression in a horizontal joining direction (this is also the axial direction of the pipe or cylinder) is not possible so that the connection is securely retained.

Preferably, the locking element comprises a base plate on which a plurality of plates spaced apart in a parallel manner are arranged so as to be able to be resiliently pivoted. If a force acts in the direction of the plates protruding from the base plate, they bend in the direction of the base plate, whereby the compressibility of the locking element is produced. When the plates pivot resiliently back, the locking element is decompressed and the locking is produced. In addition, there may also be provided a covering plate which the plates abut at the bottom. In both cases, the plates should be arranged in a slightly oblique manner in order to ensure the compressibility of the locking element. The relatively smooth upper side of the locking element formed by the covering plate affords the advantage that the plates cannot become stuck in the rough surface of the core material.

The locking element may also be formed by a plurality of rectangular elements which are arranged one behind the other and of which in each case two are connected to each other at an edge and are arranged in the decompressed position at an angle $\alpha$ with respect to each other. The locking element is then constructed in a strip-like manner. When force is applied to the connection tip of two rectangular elements, they are pressed downward and consequently flat so that the angle $\alpha$ increases and the compressibility of the locking element is produced. After release of the force, the rectangular elements spring back into their decompressed position and the locking is produced.

With a device for locking two floor panels which are connected to each other and which are both constructed identically and which have a core, an upper side and a lower side, a first side edge and an opposing second side edge, and two floor panels which are connected to each other form in the connection location a locking groove whose peripheral wall is constructed to form a first portion of the core of the first panel and a second portion of the core of the second panel, and in the locking groove a locking element is inserted, the locking element may be constructed so as to be compressible in one of the horizontal direction or the vertical direction and then incompressible in the other of the vertical direction or horizontal direction. As a result of this embodiment, the locking element can be used for locking two panels both in a horizontal direction and in a vertical direction. Whether the locking element is compressible in the horizontal direction or whether it is compressible in the vertical direction is dependent only on the installation position thereof. If it is intended to lock two panels in a horizontal direction, it has to be constructed to be compressible in a vertical direction and incompressible and rigid in a horizontal direction; if it is intended to lock in a vertical direction, it has to be constructed to be compressible in a horizontal direction and incompressible and rigid in a vertical direction.

BRIEF DESCRIPTION OF DRAWINGS

Embodiments of the invention are intended to be explained in greater detail below with reference to the drawings, in which:

FIG. 1*a* is cross section of the locking edges extending at an angle of less than 90° with respect to the upper side.

DETAILED DESCRIPTION

Figure 1:
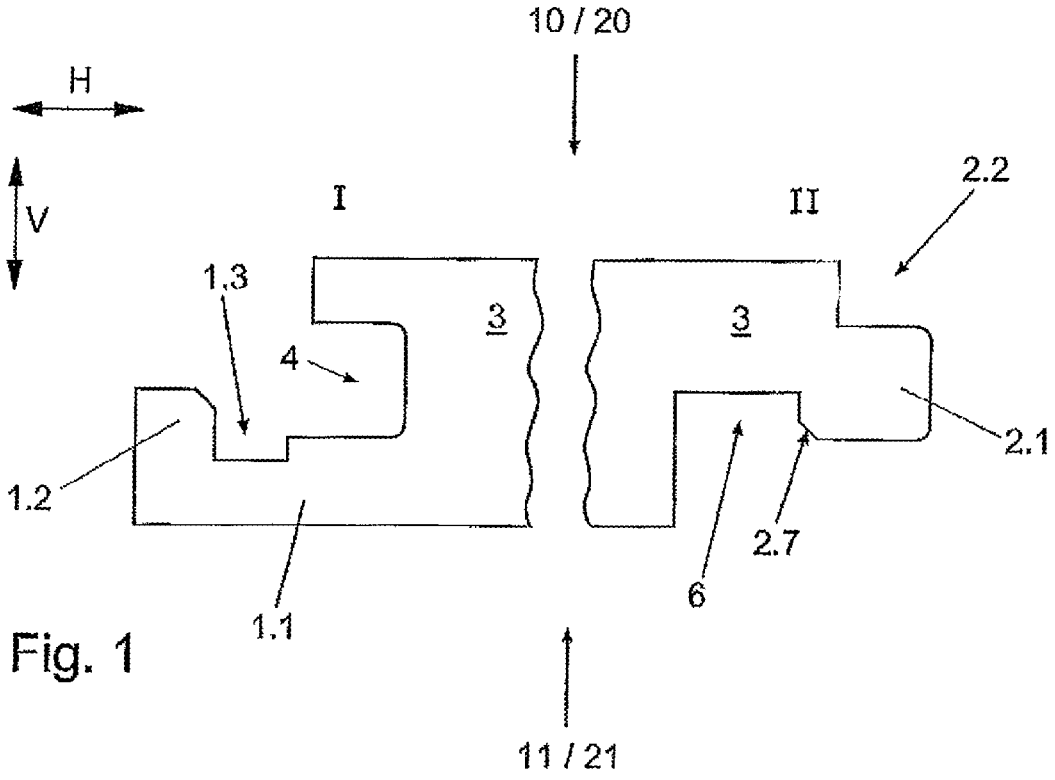
FIG. 1 is a cross-section of a floor panel.

FIG. 1 shows a floor panel 1 or 2 in cross-section with the mutually opposing side edges I, II which are profiled in such a manner that two identically constructed floor panels 1, 2 are connected to each other and can be locked to each other in a horizontal direction H and in a vertical direction V. The profiling described below is 30 preferably formed at the transverse side of rectangular floor panels 1, 2. It is particularly highly suitable for square floor panels 1, 2. FIG. 1*a* shows the locking edges (1.5, 2.5) extending at an angle of less than 90° with respect to the upper side (10, 20).

The floor panels 1, 2 are connected to each other by a first row of panels 01, 02 initially being connected to each other at the side edges I, II and then in a second row of panels the first panel 1 initially being angled with the longitudinal side thereof into the row of panels 01, 02 which has already been laid then in a substantially vertical joining movement pivoted in a downward direction onto the lower floor. The second panel 2 is then angled with the longitudinal side thereof into the row of panels 01, 02 which has already been laid, then also pivoted downward in a substantially vertical joining movement onto the lower floor and then placed with the second side edge II against the first side edge I of the first panel 1 which has already been laid in the second row. However, this will be described in greater detail below.

The floor panel 1, 2 comprises a core 3 of wood-based material or a wood-based material/plastics material mixture and can be coated at the upper side 10, 20 thereof and/or lower side 11, 21 thereof with a decorative layer. The floor panels 1, 2 are constructed identically. The floor panel 1 will be referred to below when the first side edge I is involved and the floor panel 2 will be referred to below when the second side edge II is involved.

At the first side edge I thereof, the panel 1 is provided with a horizontal groove 4 which is provided in a horizontal direction H and which forms an upper wall 4.1, an inner wall 4.2 and a lower wall 4.3.

At the opposing second side edge II thereof, the panel 2 is provided with a tongue 2.1, which as a result of a graduation 2.2 which is produced when the side edge II is milled from the upper side 20 to the lower side 21 forms a tongue tip 2.3. As a result of a stepped vertical groove 6 which is open in the direction toward the lower side 21, there is formed at the side of the tongue 2.1 opposite the tongue tip 2.3 a second locking edge 2.5 which can be connected in a state merging into a chamfer 2.7 to the base 2.6 of the tongue 2.1.

The lower wall 4.3 is formed by the upper side 1.4 of a lower lip 1.1 which protrudes over the side edge I and which is provided at the outer end thereof with a projection 1.2 which faces toward the upper side 10 and on which a first locking edge 1.5 which extends parallel with the inner wall 4.2 of the horizontal groove 4 is formed. The spacing between the first locking edge 1.5 and the inner wall 4.2 is greater than the length of the base 2.6 of the tongue 2.1 from the tongue tip 2.3 to the second locking edge 2.5.

Figure 2A:
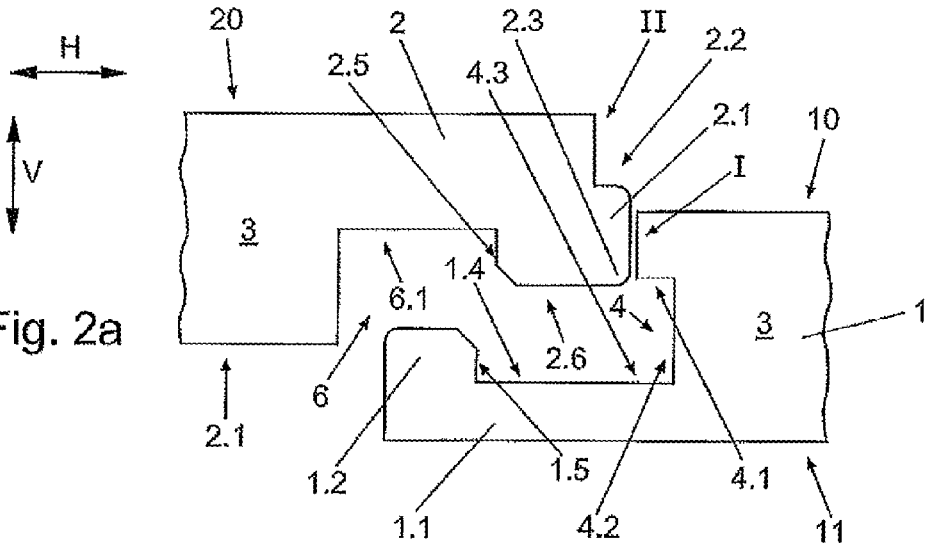
FIG. 2*a* is a partial cross-section of two floor panels at the connection location at the beginning of the joining movement according to a first embodiment.
Figure 2B:
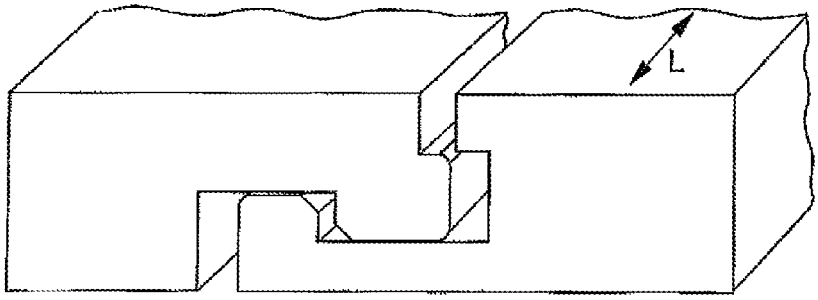
FIG. 2*b* shows the representation according to FIG. 2*a* in the course of the continuing joining movement.
Figure 2C:
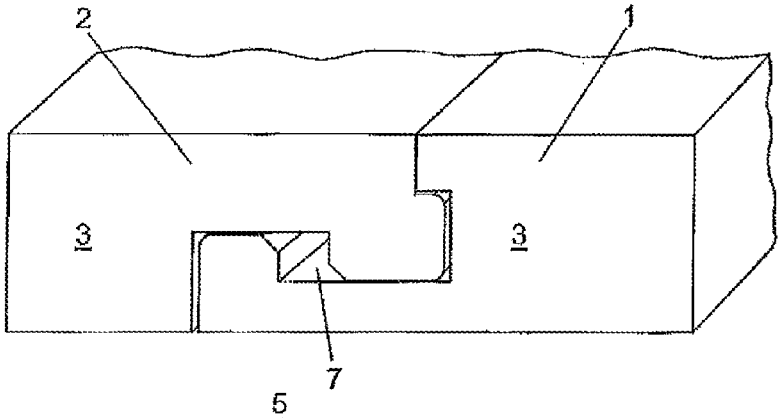
FIG. 2*c* shows the representation according to FIG. 2*b* at the end of the joining movement.
Figure 2D:
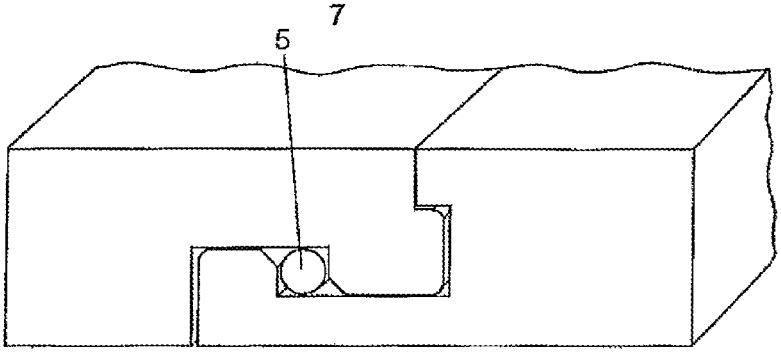
FIG. 2*d* shows the representation according to FIG. 2*c* with the locking element inserted.
Figure 3A:
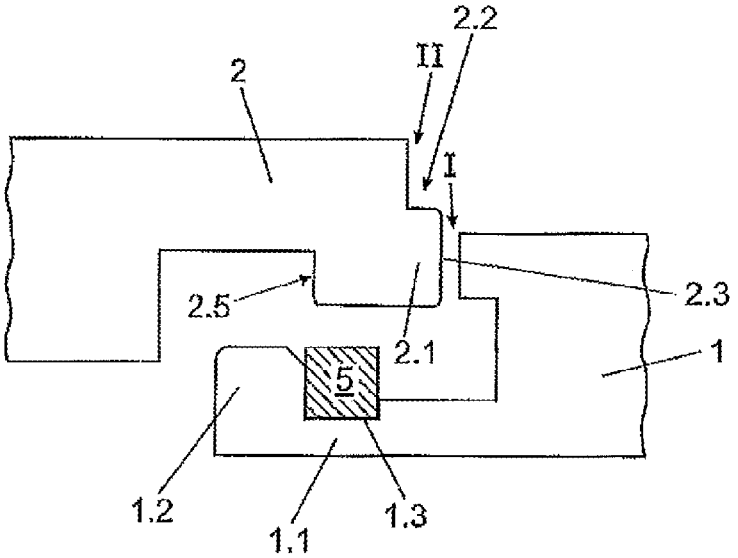
FIG. 3*a* is a partial cross-section of two floor panels at the connection location at the beginning of the joining movement according to a second embodiment.
Figure 3B:
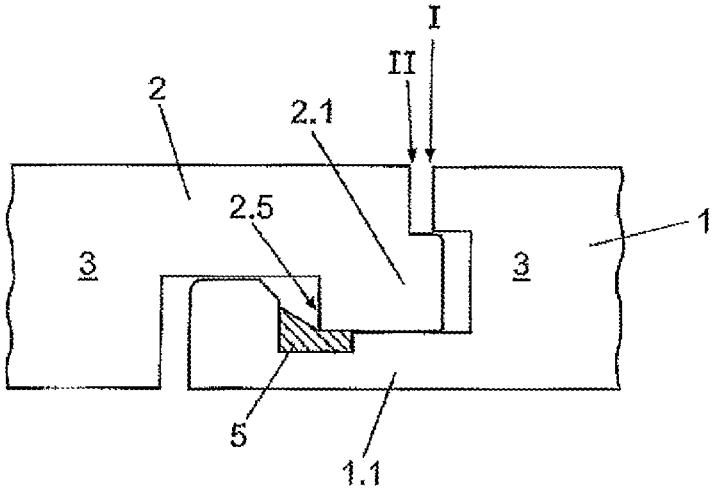
FIG. 3*b* shows the representation according to FIG. 3*a* in the course of the continuing joining movement.
Figure 3C:
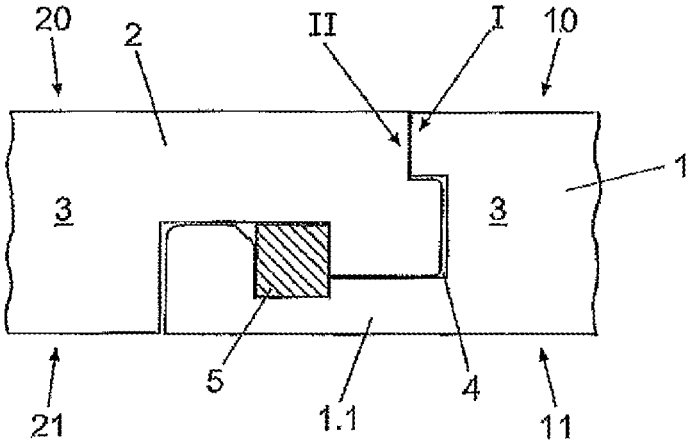
FIG. 3*c* shows the representation according to FIG. 3*b* at the end of the joining movement.

FIGS. 2*a* to 2*d* show the joining movement for connecting the second panel 2 to a panel 1 which has already been laid, which movement is substantially carried out by means of a vertical downward pivoting onto the lower floor (cf. FIG. 4). The second panel 2 is initially angled into a row of panels 01, 02 which has already been laid and then lowered with the tongue 2.1 thereof onto the lower lip 1.1 of the first panel 1 until the tongue 2.1 rests with the base 2.6 thereof on the upper side of the lower lip 1.1 (FIG. 2*b*). The second panel 2 is then displaced in a horizontal direction H so that the tongue 2.1 is inserted into the horizontal groove 4 until the abutment faces of the side edges I, II are in abutment with each other. Between the tongue tip 2.3 of the tongue 2.1 and the inner wall 4.2 of the horizontal groove 4 there is formed an intermediate space which can act as a dust pocket. Between the first locking edge 1.5 and the second locking edge 2.5 there is produced an intermediate space which forms between the panels 1,2 a locking groove 7 into which the locking element 5 can be inserted (cf. FIG. 4*c*).

In another embodiment of the invention, there is additionally formed in the lower lip 1.1 a groove 1.3 which is adjacent to the projection 1.2 and in which the locking element 5 is placed. The locking element 5 is compressible in a vertical direction V. Toward the end of the lowering movement, the base 2.6 of the tongue 2.1 compresses the locking element 5. During the following horizontal connection movement, when the tongue 2.1 has been introduced into the horizontal groove 4 and the connection faces of the side edges I, II are in abutment with each other, the locking element 5 can spring back into the intermediate space which is formed between the first locking edge 1.5 and the lateral locking edge 2.5 and which acts as a locking groove 7.

Figure 5A:
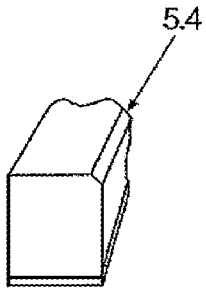
FIG. 5*a* is a side view of a first locking element.
Figure 6A:
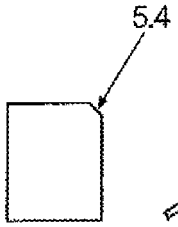
FIG. 6*a* is a side view of a second locking element.

The chamfer 2.7, with which the locking edge 2.5 merges into the base 2.6 of the tongue 2.1, ensures that the locking element 5 after it has been compressed can also rebound into the locking groove 7. If the chamfer 2.7 is not intended to be fitted, it would be advantageous to allow the locking edge 2.7 to extend in a slightly oblique manner toward the upper side 20. The same effect can also be achieved when the resilient locking element 5 is configured in a slightly oblique manner at the side thereof facing the locking edge 2.5, as would be the case, for example, with the locking elements 5 which are round in cross-section, as illustrated in FIGS. 7 and 8—or has a chamfer 5.4 (FIGS. 5*a*, 6*a*). In any case, however, it should certainly be assumed that the locking element 5 springs back into the locking groove 7. Even if this should be only partially the case, a locking occurs in the horizontal direction H.

The locking element 5 may be used as a separate component, which is placed in the groove 1.3 at the time of laying, but it can also be placed in the groove 1.3 in the factory and secured at that location, for example, adhesively bonded.

Figure 4A:
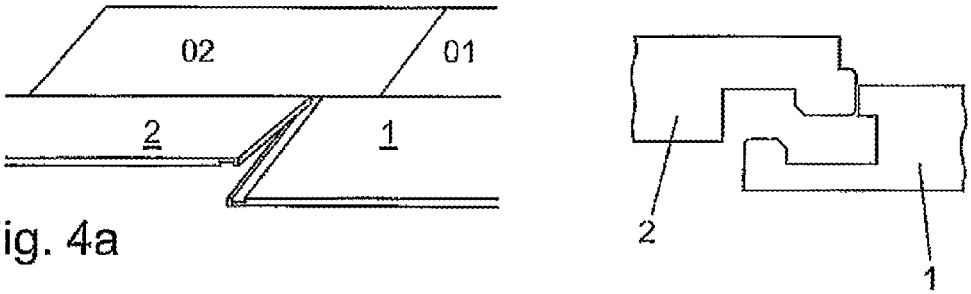
FIG. 4 shows the time sequence of the connection and locking of the floor panels.
Figure 4B:
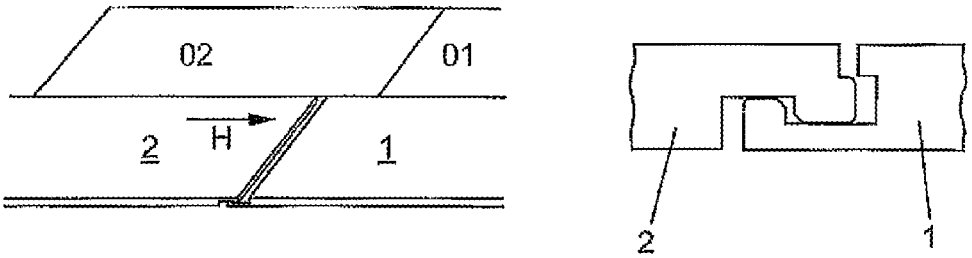
Figure 4C:
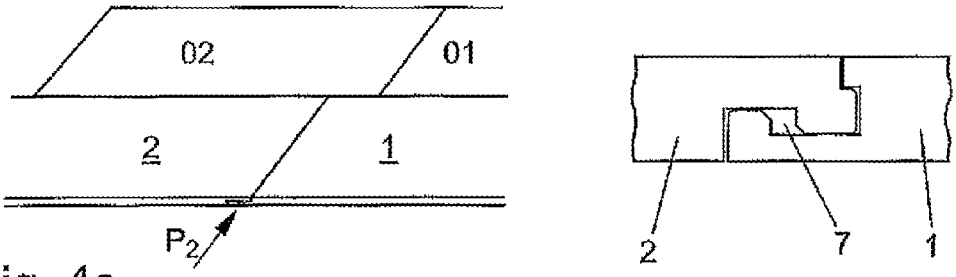
Figure 4D:
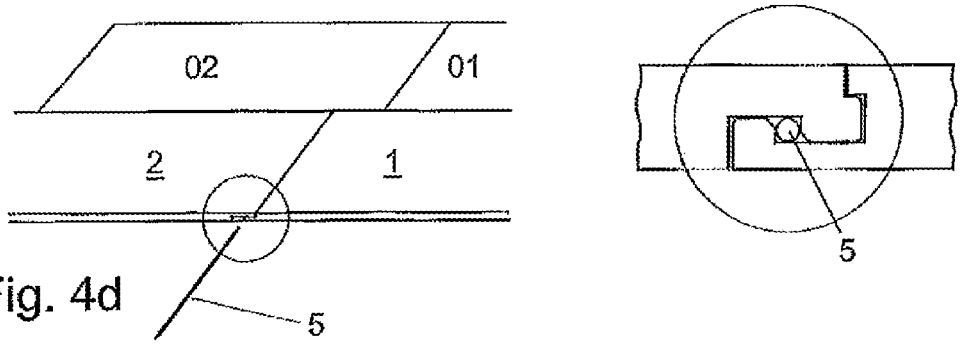

With reference to FIGS. 4*a* to 4*c*, which each correspond to the representations of the connection/locking of the two panels 1, 2 according to FIG. 2*a* to 2*c* or 3*a* to 3*c*, it can be seen how the laying of the floor panels is carried out. Firstly, a first row is configured with panels 01, 02, etc. There is then placed on this first row a first floor panel 1 by being laid at an angle on the corresponding longitudinal side and then pivoted down onto the lower floor. The next floor panel 2 is also first placed with the longitudinal side against the panel 01 which has already been laid in the first row and then pivoted down in the direction of the lower lip 1.1 of the first panel 1. When the tongue 2.1 rests on the lower lip 1.1, the floor panel 2 is displaced horizontally in the direction of the floor panel 1 so that the tongue 2.1 reaches the horizontal groove 4, whereby the locking of the panels 1, 2 with respect to each other is carried out in a vertical direction V. After the locking element 5 has been placed in the locking groove (FIG. 4*d*) or when the compressed locking element 5 has been decompressed again and rebounds in the direction of the upper side of the panel 2, the locking of the panels 1, 2 with respect to each other in the horizontal direction H is produced.

Figure 5B:
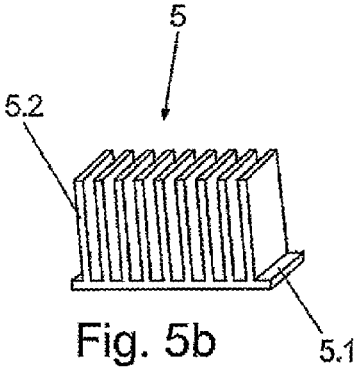
FIG. 5*b* is a perspective view of the locking element according to FIG. 5*a* in the decompressed state.
Figure 5C:
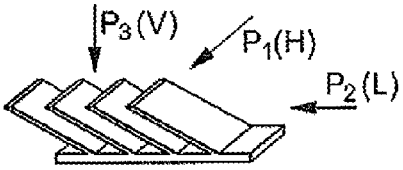
FIG. 5*c* shows the locking element according to FIG. 5*b* in the compressed state.

FIGS. 5*a* to 5*c* show a first embodiment of a decompressible resilient element 5 which has a rectangular shape in cross-section. A plurality of plates 5.2 which protrude in a vertical direction from a base plate 5.1 are resiliently connected to the base plate 5.1. With respect to the base plate 5.1, the plates 5.2 extend in a slightly oblique manner. They can be angled in the direction of the base plate 5.1 and then pivot back into their upright position if no more force is applied to them in a vertical direction V (arrow $P_3$). There may be provided a covering plate (not shown) which is arranged parallel with the base plate 5.1 and against the lower side of which the plates 5.2 abut. It can be seen that, as a result of an application of force in the direction of the arrow $P_3$, there is enabled a redirection of the plates 5.2 which then bend in the direction of the arrow $P_2$ which corresponds to the longitudinal direction L of the side edge I, II (cf. FIG. 2*b*), whereby a compression of the locking element 5 is carried out, but a compression in a horizontal direction H of the arrow $P_1$ which corresponds to the horizontal direction H illustrated in FIGS. 2 and 3 is excluded. This also applies to the alternative locking elements described below.

Figure 6B:
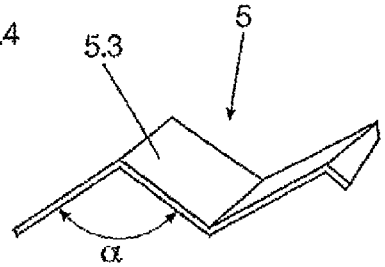
FIG. 6*b* is a perspective view of a second locking element in the decompressed state.
Figure 6C:
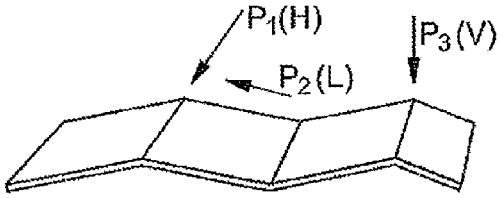
FIG. 6*c* shows the locking element according to FIG. 6*b* in the compressed state.

FIGS. 6*a* to 6*c* show another embodiment of a locking element 5 which comprises a strip which is angled several times and which can be pressed flat by means of a vertical application of force and which after release of the force springs back into its original shape and is then decompressed again. The strip comprises a plurality of rectangular elements 5.3 which are arranged one behind the other and of which in each case two are connected to each other at an edge and in the decompressed position are arranged at an angle $\alpha$ with respect to each other.

Figure 7A:
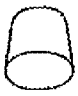
FIG. 7*a* is a side view of a third locking element.
Figure 7B:
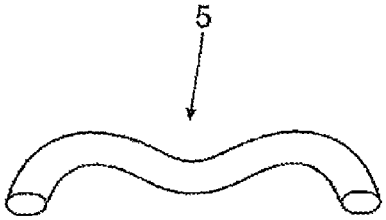
FIG. 7*b* is a perspective view of a third locking element in the decompressed state.
Figure 7C:
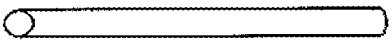
FIG. 7*c* shows the locking element according to FIG. 7*b* in the compressed state.

FIGS. 7*a* to 7*c* show a locking element 5 which is constructed in a tubular manner and is undulating and in a similar manner to the locking element 5 which is illustrated in FIG. 6 can be compressed and decompressed again by means of corresponding rebounding.

Figure 8A:
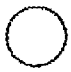
FIG. 8*a* is a side view of a fourth locking element.
Figure 8B:
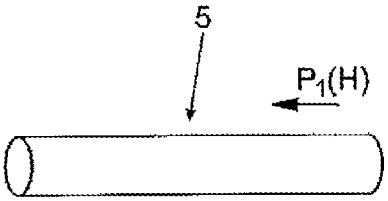
FIG. 8*b* is a perspective view of a fourth locking element in the decompressed state.
Figure 8C:
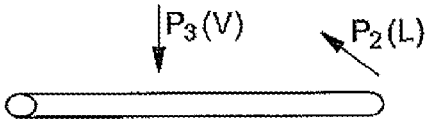
FIG. 8*c* shows the locking element according to FIG. 8*b* in the compressed state.

FIGS. 8*a* to 8*c* show a particularly simple form of a locking element 5 which is constructed in a tubular or cylindrical manner. Upon application of force, the locking element 5 is compressed and assumes the form 1 shown in FIG. 8*b*. After release of the force, it springs back again and assumes the tubular or cylindrical cross-section again.

The invention claimed is:

1. A device for locking two floor panels which are connected to each other and which are constructed identically and which comprise a core, an upper side and a lower side, a first side edge and an opposing second side edge, and at the upper side, the first side edge of the first floor panel abuts the second side edge of the second floor panel, comprising: in the first side edge a horizontal groove extending into the core and which includes an upper wall, an inner wall and a lower wall, wherein the lower wall is formed by a lower lip which protrudes at the first side edge and which has at an outer end thereof a projection which faces in a direction of the upper side and which has a first locking edge, and in a region of the connection location of the two floor panels at least one locking element is inserted, and wherein at the second side edge there is provided a tongue which protrudes outward and which has at an outer end thereof a graduation which forms a tongue tip and at an end thereof facing the core a second locking edge which extends in a vertical direction, wherein the second locking edge is an outer wall of a vertical groove which is open in a direction facing the lower side and in which the projection engages, and the locking is carried out in a vertical direction by the tongue tip which engages in the horizontal groove and in a horizontal direction by the locking element which is supported on the first locking edge of the projection and on the second locking edge of the tongue, wherein the locking element is compressible in the vertical direction and incompressible in the horizontal direction, wherein, in a locked state between the two floor panels, an inner wall of the first locking edge extends past an inner wall of the second locking edge, in the vertical direction.

2. The device as claimed in claim 1, wherein the first and second locking edges extend parallel with each other.

3. The device as claimed in claim 2, wherein the locking edges extend at an angle of less than 90° with respect to the upper side.

4. The device as claimed in claim 1, further comprising a locking element groove which is adjacent to the projection and which is provided in the lower lip for at least partially receiving the locking element.

5. The device as claimed in claim 4, wherein the locking element is placed in the groove which is provided in the lower lip.

6. The device as claimed in claim 1, wherein the locking element is inserted between two floor panels such that the two panels are connected to each other.

7. The device as claimed in claim 1, wherein the locking element is securely connected to the lower lip.

8. The device as claimed in claim 7, wherein the locking element is securely connected to the lower lip by an adhesive bond.

9. The device as claimed claim 1, further comprising a plurality of locking elements provided with spacing from each other.

10. The device as claims in claim 1, wherein the two floor panels comprise a first floor panel and a second floor panel, the second floor panel is connected with the first floor panel by vertical downward pivoting and lowering until a base of the tongue compresses the locking element and is then displaced in a horizontal direction so that the locking element springs back.

11. The device as claimed in claim 1, wherein the tongue includes an upper wall and a lower wall, the upper wall and lower wall of the tongue being parallel with the upper wall and the lower wall of the horizontal groove.

12. A device for locking two floor panels which are connected to each other and which are constructed identically and which comprise a core, an upper side and a lower side, a first side edge and an opposing second side edge, and at the upper side, the first side edge of the first floor panel abuts the second side edge of the second floor panel, comprising: in the first side edge a horizontal groove extending into the core and which includes an upper wall, an inner wall and a lower wall, wherein the lower wall is formed by a lower lip which protrudes at the first side edge and which has at an outer end thereof a projection which faces in a direction of the upper side and which has a first locking edge, and in a region of the connection location of the two floor panels at least one locking element is inserted, and wherein at the second side edge there is provided a tongue which protrudes outward and which has at an outer end thereof a graduation which forms a tongue tip and at an end thereof facing the core a second locking edge which extends in a vertical direction, wherein the second locking edge is an outer wall of a vertical groove which is open in a direction facing the lower side and in which the projection engages, and the locking is carried out in a vertical direction by the tongue tip which engages in the horizontal groove and in a horizontal direction by the locking element which is supported on the first locking edge of the projection and on the second locking edge of the tongue, wherein the locking element is compressible in the vertical direction and incompressible in the horizontal direction, wherein the tongue includes an upper wall and a lower wall, the upper wall and lower wall of the tongue being parallel with the upper wall and the lower wall of the horizontal groove, and the lower wall of the horizontal groove includes a locking element groove in which the locking element is placed, the locking element groove having a lower surface which is parallel to the upper and lower walls of both the tongue and the horizontal groove.

13. The device as claimed in claim 12, wherein the locking element groove extends to a tapered edge of the projection, which faces towards the inner wall of the horizontal groove.

14. The device as claimed in claim 13, wherein the first locking edge includes an inner wall, the second locking edge includes an inner wall, and the inner wall of the first locking edge is parallel with the inner wall of the second locking edge.

15. The device as claimed in claim 14, wherein, in a locked state between the two floor panels, the inner wall of the first locking edge is separated from the inner wall of the second locking edge by the locking element within the locking element groove.

16. A device for locking two floor panels, comprising:

in a first side edge of a first floor panel, a horizontal groove extends into a core and includes an upper wall, an inner wall and a lower wall, the lower wall being formed by a lower lip which protrudes at the first side edge and which has at an outer end a projection which extends past and faces in a direction of an upper side of the first floor panel, and which has a first locking edge, at least one locking element in the horizontal groove, and at a second side edge of a second panel, a tongue protrudes outward and includes at an outer end a graduation which forms a tongue tip and at an end thereof facing the core a second locking edge which extends in a vertical direction, the second locking edge being an outer wall of a vertical groove which is open in a direction facing a lower side of the second panel and in which the projection engages, the locking is carried out in both a vertical direction and in a horizontal direction, the locking element is compressible in the vertical direction and incompressible in the horizontal direction, and the first locking edge and the second locking edge extend parallel with each other and the lower wall of the horizontal groove includes a locking element groove in which the locking element is placed, the locking element groove having a lower surface which is parallel to the upper and lower walls of both the tongue and the horizontal groove.

* * * * *